US011092038B2

(12) United States Patent
Montgomery et al.

(10) Patent No.: US 11,092,038 B2
(45) Date of Patent: Aug. 17, 2021

(54) NOTCHED AXIAL FLANGE FOR A SPLIT CASE COMPRESSOR

(71) Applicant: United Technologies Corporation, Farmington, CT (US)

(72) Inventors: Stuart K. Montgomery, Jupiter, FL (US); Joshua L. Mardis, Palm Beach Gardens, FL (US); John Johnsen, Jupiter, FL (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 148 days.

(21) Appl. No.: 16/365,126

(22) Filed: Mar. 26, 2019

(65) Prior Publication Data

US 2020/0308987 A1 Oct. 1, 2020

(51) Int. Cl.
*F01D 25/24* (2006.01)
*F01D 25/26* (2006.01)

(52) U.S. Cl.
CPC ..... *F01D 25/265* (2013.01); *F01D 25/243* (2013.01); *F05D 2240/14* (2013.01)

(58) Field of Classification Search
CPC ... F01D 25/265; F01D 25/243; F05D 2240/14
See application file for complete search history.

(56) References Cited

U.S. PATENT DOCUMENTS

| | | | | |
|---|---|---|---|---|
| 3,628,884 | A | 12/1971 | Mierley | |
| 4,208,777 | A * | 6/1980 | Walsh | F01D 25/243 29/418 |
| 6,352,404 | B1 * | 3/2002 | Czachor | F01D 25/243 415/116 |
| 10,202,870 | B2 * | 2/2019 | Monteiro | F01D 25/265 |
| 10,502,061 | B2 * | 12/2019 | Pankratov | F01D 5/10 |
| 2016/0017752 | A1 | 1/2016 | Coffin et al. | |
| 2016/0281541 | A1 * | 9/2016 | Monteiro | F01D 25/243 |
| 2018/0087384 | A1 * | 3/2018 | Pankratov | F01D 5/10 |
| 2018/0266464 | A1 | 9/2018 | Klingels et al. | |
| 2018/0291766 | A1 | 10/2018 | Uetsuki et al. | |

OTHER PUBLICATIONS

European Seach Report for Application No. 20 16 4232; dated Aug. 19, 2020.

* cited by examiner

*Primary Examiner* — Eldon T Brockman
(74) *Attorney, Agent, or Firm* — Cantor Colburn LLP

(57) ABSTRACT

A split case compressor including a first compressor case segment including a first split flange extending axially and a first axial flange extending circumferentially about the first compressor case segment. The compressor also includes a second compressor case segment including a second split flange extending axially and a second axial flange extending circumferentially about the second compressor case segment, the first and second split flanges forming an overall split flange for securing the first compressor case segment and the second compressor case segment to each other. The compressor further includes a notch of at least one of the first axial flange and the second axial flange proximate the overall split flange.

20 Claims, 2 Drawing Sheets

NOTCHED AXIAL FLANGE FOR A SPLIT CASE COMPRESSOR

BACKGROUND

Exemplary embodiments pertain to the art of gas turbine engines and, more particularly, to a notched axial flange for a split case compressor.

Low and high pressure compressors typically incorporate split case designs to allow assembly and ease of access to the low and high pressure compressor airfoils. The split case design requires high strength fasteners to hold the two halves securely together along a split flange. The ends of the split case have axial flanges that provide mating surfaces to other cases. These axial flanges provide significant local stiffness driving load into the split flange, thereby making it difficult to seal and avoid leakage.

BRIEF DESCRIPTION

Disclosed is a split case compressor. The compressor includes a first compressor case segment including a first split flange extending axially and a first axial flange extending circumferentially about the first compressor case segment. The compressor also includes a second compressor case segment including a second split flange extending axially and a second axial flange extending circumferentially about the second compressor case segment, the first and second split flanges forming an overall split flange for securing the first compressor case segment and the second compressor case segment to each other. The compressor further includes a notch of at least one of the first axial flange and the second axial flange proximate the overall split flange.

In addition to one or more of the features described above, or as an alternative, further embodiments may include that the first and second axial flanges are located at respective aft ends of the first and second compressor case segments.

In addition to one or more of the features described above, or as an alternative, further embodiments may include that the first and second axial flanges are located at respective forward ends of the first and second compressor case segments.

In addition to one or more of the features described above, or as an alternative, further embodiments may include that the notch is a scalloped cutout.

In addition to one or more of the features described above, or as an alternative, further embodiments may include that the notch is a rectilinear cutout.

In addition to one or more of the features described above, or as an alternative, further embodiments may include that the first axial flange includes a first notch extending radially inwardly from a first radially outward surface of the first axial flange and the second axial flange includes a second notch extending radially inwardly from a second radially outward surface of the second axial flange.

In addition to one or more of the features described above, or as an alternative, further embodiments may include that the first notch extends further radially inward than the second notch.

In addition to one or more of the features described above, or as an alternative, further embodiments may include that the second notch extends further radially inward than the first notch.

In addition to one or more of the features described above, or as an alternative, further embodiments may include that the first notch is located circumferentially closer to the overall split flange than the second notch is.

In addition to one or more of the features described above, or as an alternative, further embodiments may include that the second notch is located circumferentially closer to the overall split flange than the first notch is.

Also disclosed is a gas turbine engine including a fan section, a combustor section, a turbine section, and a compressor section. The compressor section includes a first compressor case segment. The compressor section also includes a second compressor case segment operatively coupled to the first compressor case segment along a split flange extending axially. The compressor section further includes a first axial flange extending circumferentially about the first compressor case segment. The compressor section yet further includes a second compressor case segment including a second axial flange extending circumferentially about the second compressor case segment, at least one of the first and second axial flanges having a notch extending radially inward from an outer radial surface of the axial flanges proximate the split flange.

In addition to one or more of the features described above, or as an alternative, further embodiments may include that the split flange includes a first split flange extending axially and a second split flange extending axially, the first and second split flanges securing the first compressor case segment and the second compressor case segment to each other.

In addition to one or more of the features described above, or as an alternative, further embodiments may include that the first and second axial flanges are located at respective aft ends of the first and second compressor case segments.

In addition to one or more of the features described above, or as an alternative, further embodiments may include that the first and second axial flanges are located at respective forward ends of the first and second compressor case segments.

In addition to one or more of the features described above, or as an alternative, further embodiments may include that the notch is a scalloped cutout.

In addition to one or more of the features described above, or as an alternative, further embodiments may include that the notch is a rectilinear cutout.

In addition to one or more of the features described above, or as an alternative, further embodiments may include that the first notch extends further radially inward than the second notch.

In addition to one or more of the features described above, or as an alternative, further embodiments may include that the second notch extends further radially inward than the first notch.

In addition to one or more of the features described above, or as an alternative, further embodiments may include that the first notch is located circumferentially closer to the overall split flange than the second notch is.

In addition to one or more of the features described above, or as an alternative, further embodiments may include that the second notch is located circumferentially closer to the overall split flange than the first notch is.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
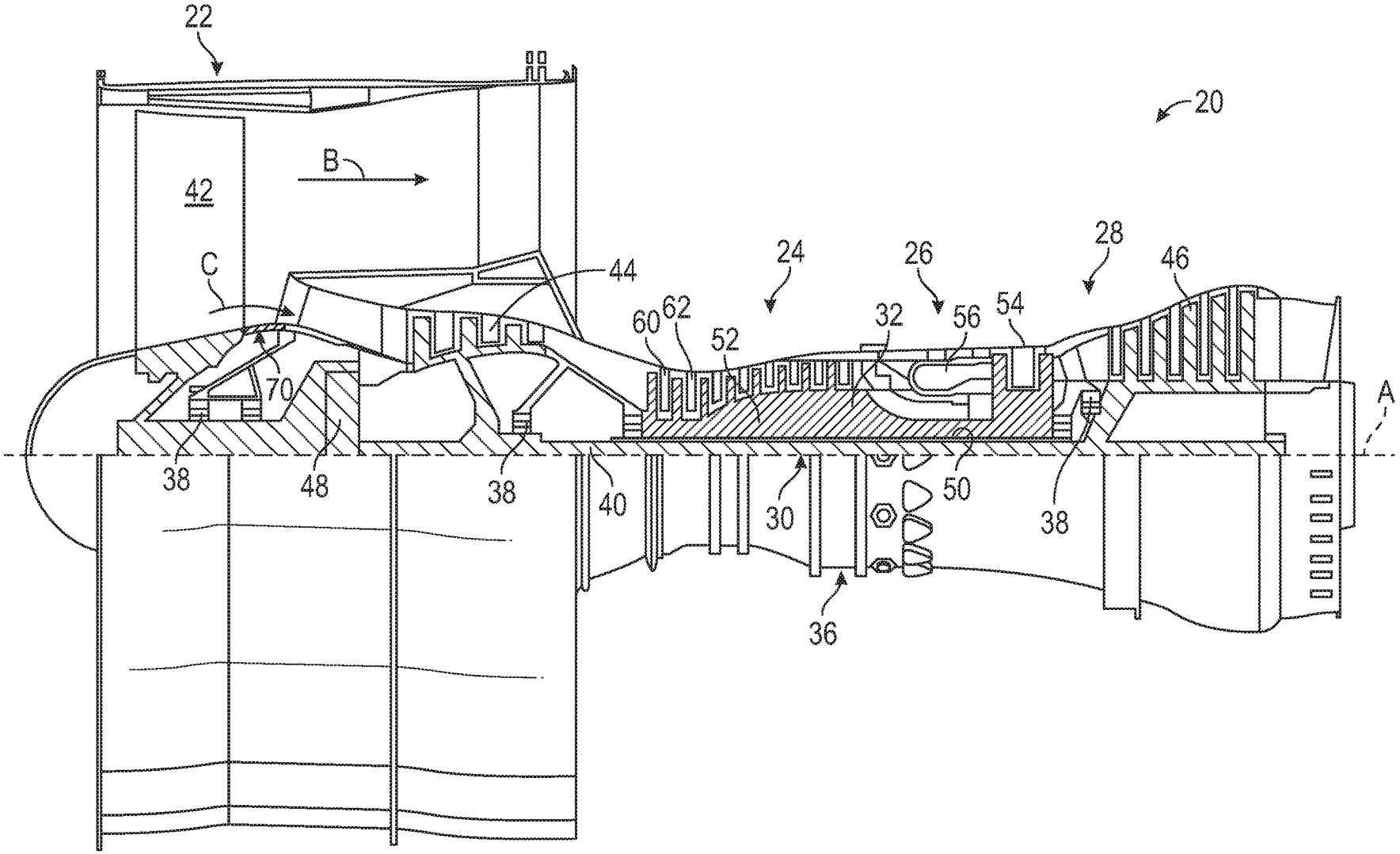
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct, while the compressor section 24 drives air along a core flow path C for compression and communication into the combustor section 26 then expansion through the turbine section 28.

The exemplary engine 20 generally includes a low speed spool 30 and a high speed spool 32 mounted for rotation about an engine central longitudinal axis. A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 feet (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram } °R)/(518.7° R)]^{0.5}$. The "Low corrected fan tip speed" as disclosed herein according to one non-limiting embodiment is less than about 1150 ft/second (350.5 m/sec).

Figure 2:
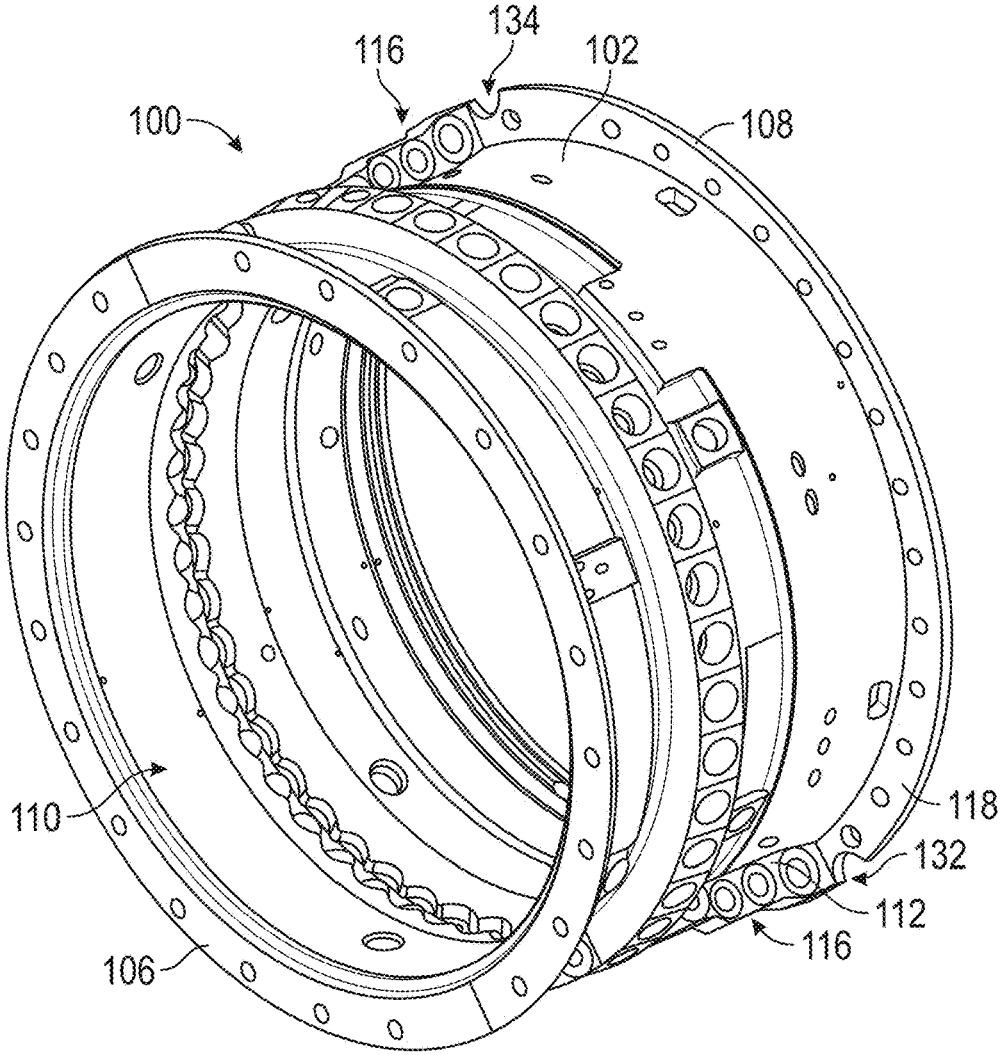
FIG. 2 is a perspective view of a compressor split case.

Referring now to FIG. 2, a portion of the low pressure compressor 44 or the high pressure compressor 52 is illustrated. In particular, a compressor case is shown in the form of a split case compressor 100. The split case compressor 100 is formed of at least two segments, but typically only two substantially semi-circular segments that attach to each other for ease of assembly/disassembly and maintenance. In the illustrated embodiment, the split case compressor 100 includes a first compressor case segment 102 and a second compressor case segment 104.

Each segment 102, 104 extends axially from a first axial end (e.g., axial forward end) 106 to a second axial end (e.g., axial aft end) 108 in a longitudinal direction X that may be substantially parallel to longitudinal axis A (FIG. 1), which substantially corresponds to a direction of airflow through the compressor. Each compressor segment 102, 104 also extends circumferentially to form a half-shell. When positioned in an assembled condition, the segments 102, 104 define a path 110 for compressor components to be disposed within and air to flow through.

The first compressor case segment 102 includes a first split flange 112 extending axially in the longitudinal direction X from the axial first end 106 to the axial second end 108, or at least along a portion thereof. Similarly, the second compressor case segment 104 includes a second split flange 114 extending axially in the longitudinal direction X from the axial first end 106 to the axial second end 108, or at least along a portion thereof. Together, the first and second split flanges 112, 114 form an overall split flange 116 for securing the first compressor case segment 102 to the second compressor case segment 104 in an assembled condition. The overall split flange 116 of one side of the split case compressor 100 are shown in FIG. 2, but it is to be appreciated that a similar or identical split flange is present on the opposing side of the split case compressor 100 (not shown). The first and second split flanges 112, 114 each include apertures for receiving mechanical fasteners that join the first and second compressor case segments 102, 104.

The first compressor case segment 102 includes a first axial flange 118 that protrudes from the case segment 102 radially outward and extends circumferentially about the case segment 102. Similarly, the second compressor case segment 104 includes a second axial flange 120 that protrudes from the case segment 104 radially outward and extends circumferentially about the case segment 104. It is to be appreciated that the axial flanges 118, 120 may extend partially (less than 180 degrees) or completely (about 180 degrees) about the circumferential segment of each case segment 102, 104. Each axial flange 118, 120 includes one or more apertures for allowing mechanical fasteners to secure the case segments 118, 120 to an axially adjacent case segment (not shown). As shown, the axial flanges 118, 120 may be located at the first axial end 106 and/or the second axial end 108.

Figure 3:
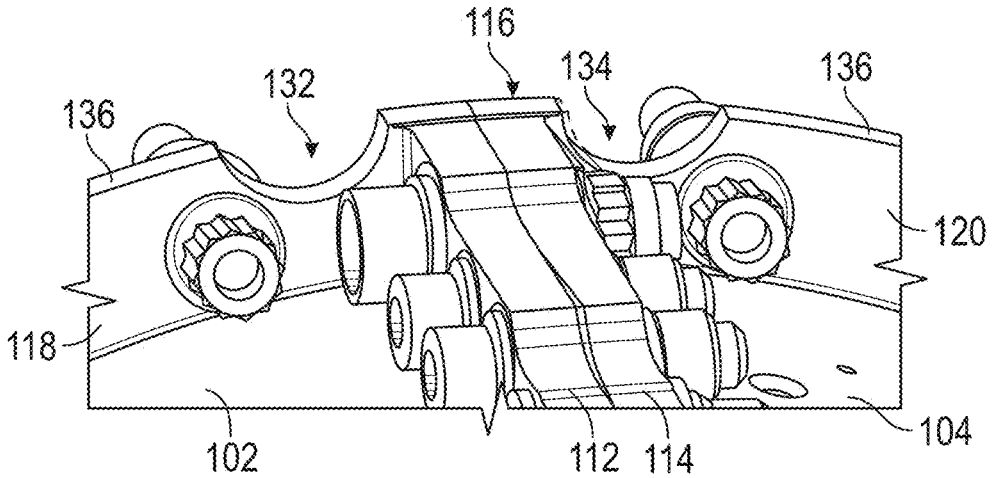
FIG. 3 is a perspective view of an interface region of a split flange and an axial flange of the compressor split case.

Referring now to FIG. 3, the axial flanges 118, 120 provide local stiffness driving load due to hoop stress present in a tightly assembled condition, with the driving load imposed on the split flange 116 (i.e., split flanges 112, 114). This is present at the interface between the split flanges 112, 114 and the axial flanges 118, 120. Such a condition presents sealing challenges in this region. To reduce the load on the split flanges 112, 114, one or more notches are provided along the first axial flange 118 and/or the second axial flange 120. As shown, a first notch 132 may be located on the first axial flange 118 proximate the first split flange 112, and a second notch 134 may be located on the second axial flange 120 proximate the second split flange 114. It is contemplated that only one of the axial flanges includes a notch.

The first and second notches 132, 134 may be any cutout or recessed feature that extends radially inward from a radially outward surface 136 of the case segments 102, 104. The notches 132, 134 may be in the form of several contemplated geometries, including but not limited to curvilinear (e.g., "scalloped), as shown, or rectilinear with sharper angled features defining the notch(es) 132, 134.

In some embodiments, one of the notches 132, 134 extends further radially inward than the other of the notches does. For example, the first notch 132 may extend further radially inward than the second notch 134 does. Alternatively, the second notch 134 may extend further radially inward than the first notch 132 does. Additionally, one of the notches 132, 134 may be located circumferentially closer to the split case 116 than the other notch is. However, it is contemplated that the notches 132, 134 are identical—or nearly identical—in shape, geometry and proximity to the split flange 116.

The notches 132, 134 disclosed herein soften the flanges at the above-described interface region (FIG. 3) to allow more efficient and practical sealing of the split flange 116. Additionally, weight savings may be achieved with the reduced material utilized in the axial flanges.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A split case compressor comprising:

a first compressor case segment including a first split flange extending axially and a first axial flange extending circumferentially about the first compressor case segment;

a second compressor case segment including a second split flange extending axially and a second axial flange extending circumferentially about the second compressor case segment, the first and second split flanges forming an overall split flange for securing the first compressor case segment and the second compressor case segment to each other; and a notch of at least one of the first axial flange and the second axial flange proximate the overall split flange, wherein the notch does not extend to the overall split flange.

2. The split case compressor of claim 1, wherein the first and second axial flanges are located at respective aft ends of the first and second compressor case segments.

3. The split case compressor of claim 1, wherein the first and second axial flanges are located at respective forward ends of the first and second compressor case segments.

4. The split case compressor of claim 1, wherein the notch is a scalloped cutout.

5. The split case compressor of claim 1, wherein the notch is a rectilinear cutout.

6. The split case compressor of claim 1, wherein the notch is a first notch in the first axial flange and the first notch extends radially inwardly from a first radially outward surface of the first axial flange and the second axial flange includes a second notch extending radially inwardly from a second radially outward surface of the second axial flange.

7. The split case compressor of claim 6, wherein the first notch extends further radially inward than the second notch.

8. The split case compressor of claim 6, wherein the second notch extends further radially inward than the first notch.

9. The split case compressor of claim 6, wherein the first notch is located circumferentially closer to the overall split flange than the second notch is.

10. The split case compressor of claim 6, wherein the second notch is located circumferentially closer to the overall split flange than the first notch is.

11. A gas turbine engine comprising:

a fan section;

a combustor section;

a turbine section; and a compressor section comprising:

a first compressor case segment;

a second compressor case segment operatively coupled to the first compressor case segment along a split flange extending axially;

a first axial flange extending circumferentially about the first compressor case segment; and a second compressor case segment including a second axial flange extending circumferentially about the second compressor case segment, at least one of the first and second axial flanges having a notch extending radially inward from an outer radial surface of the axial flanges proximate the split flange, wherein the notch does not extend to the split flange.

12. The gas turbine engine of claim 11, wherein the split flange includes a first split flange extending axially and a second split flange extending axially, the first and second split flanges securing the first compressor case segment and the second compressor case segment to each other.

13. The gas turbine engine of claim 11, wherein the first and second axial flanges are located at respective aft ends of the first and second compressor case segments.

14. The gas turbine engine of claim 11, wherein the first and second axial flanges are located at respective forward ends of the first and second compressor case segments.

15. The gas turbine engine of claim 11, wherein the notch is a scalloped cutout.

16. The gas turbine engine of claim 11, wherein the notch is a rectilinear cutout.

17. The gas turbine engine of claim 11, wherein the notch is a first notch in the first axial flange and the first notch extends radially inwardly from a first radially outward surface of the first axial flange and the second axial flange includes a second notch extending radially inwardly from a second radially outward surface of the second axial flange and the first notch extends further radially inward than the second notch.

18. The gas turbine engine of claim 11, wherein the notch is a first notch in the first axial flange and the first notch extends radially inwardly from a first radially outward surface of the first axial flange and the second axial flange includes a second notch extending radially inwardly from a second radially outward surface of the second axial flange and the second notch extends further radially inward than the first notch.

19. The gas turbine engine of claim 11, wherein the notch is a first notch in the first axial flange and the first notch extends radially inwardly from a first radially outward surface of the first axial flange and the second axial flange includes a second notch extending radially inwardly from a second radially outward surface of the second axial flange and the first notch is located circumferentially closer to the overall split flange than the second notch is.

20. The gas turbine engine of claim 11, wherein the notch is a first notch in the first axial flange and the first notch extends radially inwardly from a first radially outward surface of the first axial flange and the second axial flange includes a second notch extending radially inwardly from a second radially outward surface of the second axial flange and the second notch is located circumferentially closer to the overall split flange than the first notch is.

* * * * *